US010639772B2

(12) United States Patent
Twum

(10) Patent No.: US 10,639,772 B2
(45) Date of Patent: May 5, 2020

(54) METHOD AND APPARATUS FOR DRIVING AND POSITIONING COUPLINGS

(71) Applicant: Thomas Twum, Lakehurst, NJ (US)

(72) Inventor: Thomas Twum, Lakehurst, NJ (US)

( * ) Notice: Subject to any disclaimer, the term of this patent is extended or adjusted under 35 U.S.C. 154(b) by 97 days.

(21) Appl. No.: 15/951,223

(22) Filed: Apr. 12, 2018

(65) Prior Publication Data

US 2019/0314965 A1 Oct. 17, 2019

(51) Int. Cl.
*B25B 27/02* (2006.01)
*B25D 1/00* (2006.01)

(52) U.S. Cl.
CPC ..... *B25B 27/02* (2013.01); *B25D 1/00* (2013.01)

(58) Field of Classification Search
CPC ..... B25B 27/02; B25D 1/00; B23P 11/027; B23P 19/00; B23P 19/04; B23P 11/00; B23Q 3/00
USPC ..... 29/237, 238, 243.5, 243.55, 271, 276
See application file for complete search history.

(56) References Cited

U.S. PATENT DOCUMENTS 3,281,929 A * 11/1966 Shinnick ..... F16L 33/12 29/237
3,299,496 A * 1/1967 Christensen ..... B25B 27/10 29/237
3,585,704 A * 6/1971 Schroeder ..... B25B 7/02 29/235
4,757,588 A * 7/1988 Churchich ..... B25B 27/10 29/235
5,537,727 A * 7/1996 Mayer ..... B25B 27/10 29/237
6,751,838 B1 6/2004 Carter
8,341,816 B1 * 1/2013 Swinford ..... B25B 27/10 29/237
9,415,542 B2 8/2016 Montgomery
2003/0204943 A1 11/2003 Geurts
2006/0218765 A1 * 10/2006 Chang ..... B25B 27/10 29/237
2013/0047398 A1 * 2/2013 Zaccaria ..... B25B 27/10 29/426.1
2013/0186869 A1 * 7/2013 Matthews, Jr. ..... B25D 1/16 219/117.1

OTHER PUBLICATIONS

Unknown Author, "Central Electrofusion Installation Manual," (https://www.hdpe.ca/wp-content/uploads/2016/03/GFCP-EF-Installation-Booklet.pdf, p. 13, Section 8.

* cited by examiner

*Primary Examiner* — Sarang Afzali
*Assistant Examiner* — Darrell C Ford
(74) *Attorney, Agent, or Firm* — Hilary J. Sumner

(57) ABSTRACT

A method and apparatus for advancing a coupling along a length of pipe. The apparatus or tool is designed to sit on a segment of the pipe's outer circumference, adjacent to the coupling edge. The tool is repeatedly struck with a hammer or mallet and the force from each strike is transferred from the tool to the coupling, advancing that coupling along the pipe length until it is in the proper position. The tool geometry conforms to a portion of the pipe's exterior surface contour as well as the edge of the coupling, increasing the efficiency of the tool and minimizing damage to the fitting and pipes.

6 Claims, 7 Drawing Sheets

METHOD AND APPARATUS FOR DRIVING AND POSITIONING COUPLINGS

CROSS REFERENCE TO RELATED APPLICATIONS

Not Applicable

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

FIELD OF THE INVENTION

The present invention relates to a device for driving and positioning couplings used in a variety of plumbing assemblies.

BACKGROUND OF THE INVENTION

For the purposes of this application, the term "plumbing" shall refer to piping systems used to convey liquids and gases in both residential and commercial environments. The term "coupling" or "coupler" shall refer to any fitting, including but not limited to reducers, collars, sleeves and unions used to connect sections of piping. The terms "pipes" or "piping" shall also include tubing, ducting and conduit.

Couplings are commonly used to temporarily or permanently connect piping sections in plumbing applications. If the coupling is not centered properly between the ends of these sections, leaking may occur. Ordinarily, two pipes of equivalent diameter are connected to make one longer section of pipe; however, pipes of varying diameters may also be joined using a reducer style coupling.

Each coupling will have an inner diameter equal to or slightly larger than the corresponding exterior diameters of the pipes being joined. During installation, a coupling having a wall or annular thickness (hereinafter referred to as the annulus) is placed over an open end of one of the pipes. The two piping sections are then placed end-to end such that they are substantially aligned along their longitudinal axes, and the coupling is advanced along that longitudinal axis. When a coupling is properly installed, it is positioned such that it is substantially centered over the ends of the two pipes being joined within it (hereinafter referred to as the seam.) It should be recognized that in the case of reducers, the coupling will be placed on the pipe having the smaller of the two diameters before it is driven into place over the larger diameter pipe. Once again, the installer will advance the coupler until it is substantially centered on the pipe seam.

Oftentimes the tolerance between the inner diameter of the coupling and the outer diameter of the pipe is very tight, making it difficult to position the fitting between the pipe seam. Burrs on the pipe exterior and coupling interior can also inhibit movement of the fitting. It is especially important to properly align couplings in electrofusion applications. Electrofusion couplings are fitted with resistive elements; when a specific voltage is applied to these elements, the integrated heater coils melt both the interior of the fitting and exterior of the pipes. If the coupling is not properly centered about the pipe seam, the joint may leak or may fail prematurely.

Manufacturers typically recommend placing a wooden block on the edge of the fitting 25 and striking that block with a hammer to advance the coupling into position. See e.g. page 13, Section 8 of the "Central Electrofusion Installation Manual" https://www.hdpe.ca/wp-content/uploads/2016/03/GFCP-EF-Installation-Booklet.pdf.Oftentimes the block will force the coupling to skew as it advances and the installer must then hit another area of the coupling to correct the angle of the coupling. Consequently, this method requires frequent repositioning of the block about the circumference of the fitting and often requires the installer to hit the block outside of his line of sight. This practice is damaging to the fitting and may affect the integrity of the connection between the pipes and coupling. In addition, this approach poses a safety hazard as the wood may splinter or slip and requires the installer to spend unnecessary time squaring the coupler.

There is therefore a need in the art for a tool that can be used to drive a coupling into proper position in a manner that minimizes or eliminates damage to the plumbing components.

BRIEF SUMMARY OF THE INVENTION

The present invention addresses the problems discussed above by offering a tool that sits securely about the pipe geometry much like a saddle. The edge of the tool conforms to the coupling annulus, allowing the force applied by the tool to extend over an increased surface area on the fitting. By distributing the force over a larger segment of the annulus, the coupling will advance more uniformly and the fitting can be properly squared with a minimal amount of tool repositioning. The likelihood of slipping and damage to the coupling is also decreased.

The tool comprises an open cuff that conforms to a portion of the pipe exterior's surface contour and seats against the coupling annulus. The open-ended design simplifies tool repositioning, allowing the installer to quickly place the tool on either side of the coupling and at various points about the fitting circumference. A support structure is affixed to and extends from the cuff in such a way that the tool remains balanced when seated on the piping. This support structure may be configured in a variety of ways provided that it terminates at a striking face. An abutment end is located on the distal end of the cuff. An optional lip may extend above this abutment end such that the lip height is equal to or greater than the wall thickness of the coupling, allowing the lip to extend above the annulus.

As previously discussed, the open nature of the cuff allows for easy positioning of the tool along the longitudinal axis of the pipe surface on either side of the coupling. To use the tool, the installer places the abutment end and/or lip face of the device securely against the edge of the coupling to be advanced. The installer uses a hammer or mallet to hit the striking face of the tool. The energy from the hammer strike is transferred from the tool to the fitting, imparting a substantially uniform force against the portion of the annulus that is in contact with the tool. The installer is free to apply as much or as little intensity to the hammer strikes as needed to drive the coupling to its proper position. If the coupling has been advanced beyond its centerline, the tool can easily be repositioned on the opposite side of the coupling and used to drive the fitting back into place.

It should be understood that the tool may be made of any material having sufficient tensile strength and durability such as steel, brass, plastic or other materials of similar strength. If the tool will be used in a volatile environment, it may be constructed of spark-resistant materials such as plastic, brass, bronze, aluminum, copper-nickel alloys, copper-aluminum alloys and copper-beryllium alloys. Alternatively, the tool may be coated with rubber, plastic, silicone or similar material to prevent sparking during the striking process. Ideally, the shape, length, and angle of the support structure as well as the total cuff area in contact with the exterior pipe surface will be optimized such that tool remains balanced when seated on the pipe.

As previously discussed, the geometry of the cuff is designed to fit snugly over the exterior of the plumbing being installed. If the pipe is circular, for instance, the arc of the cuff will substantially match the curvature corresponding to the circumference of the pipe being used. It should be recognized that the pipe may not be circular in every application as a variety of piping geometries are employed in plumbing design. Square, rectangular, oval, triangular, hexagonal and octagonal piping are well known in the art. It should therefore be understood that the cuff may take a variety of shapes to accommodate these varying pipe geometries and their corresponding couplings.

REFERENCE NUMERALS

5 Pipe
10 Pipe Seam
15 Exterior Surface Contour of Pipe
20 Longitudinal Axis of Pipe
25 Coupling
30 Cuff
35 Abutment End
40 Lip Face
45 Support Frame
50 Junction Point
55 Striking Face
60 Annulus
65 Handle
70 Cuff Length
75 Cuff Width

DETAILED DESCRIPTION OF THE INVENTION

Figure 1A:
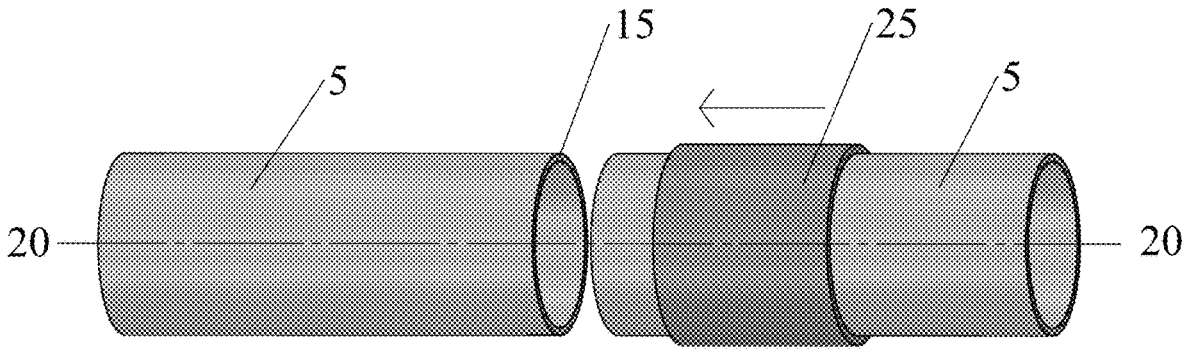
FIG. 1A provides a perspective view of a two unassembled pipes and a coupling.
Figure 1B:
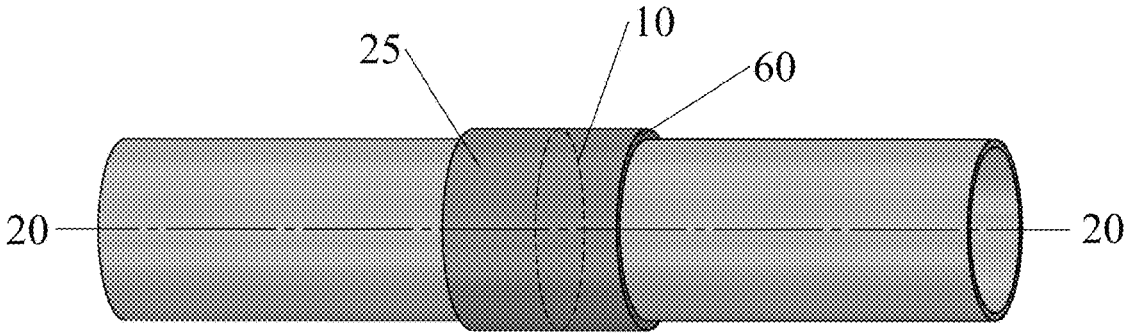
FIG. 1B provides a perspective view of two pipes having a coupling centered over the seam.
Figure 1C:
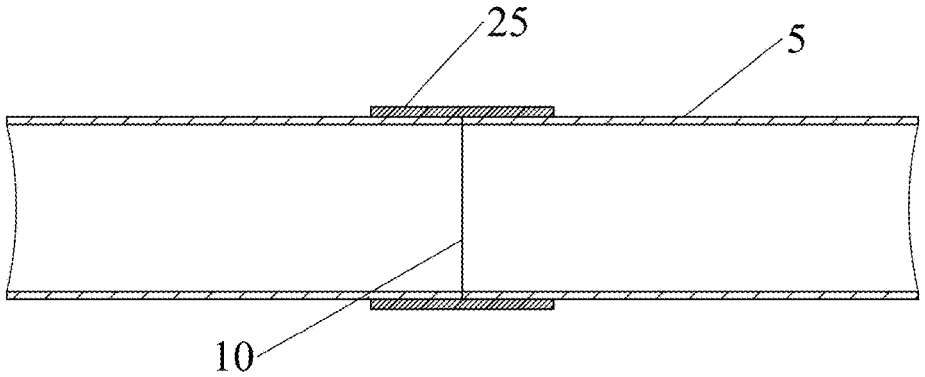
FIG. 1C provides a cross-sectional view of the assembled pipes and coupling.

FIGS. 1A and 1B depict a typical plumbing installation wherein two pipes 5, each having at least one open end, are joined by a coupling 25. Each pipe 5 has an exterior surface contour 15 and a longitudinal axis 20. Referring now to FIG. 1C, when the coupling 25 is properly installed, it is positioned such that it is substantially centered over the seam 10. As previously discussed, the tolerance between the coupling 25 and pipe 5 is often very tight, making it difficult to center the coupling 25 over the seam 10.

Figure 2A:
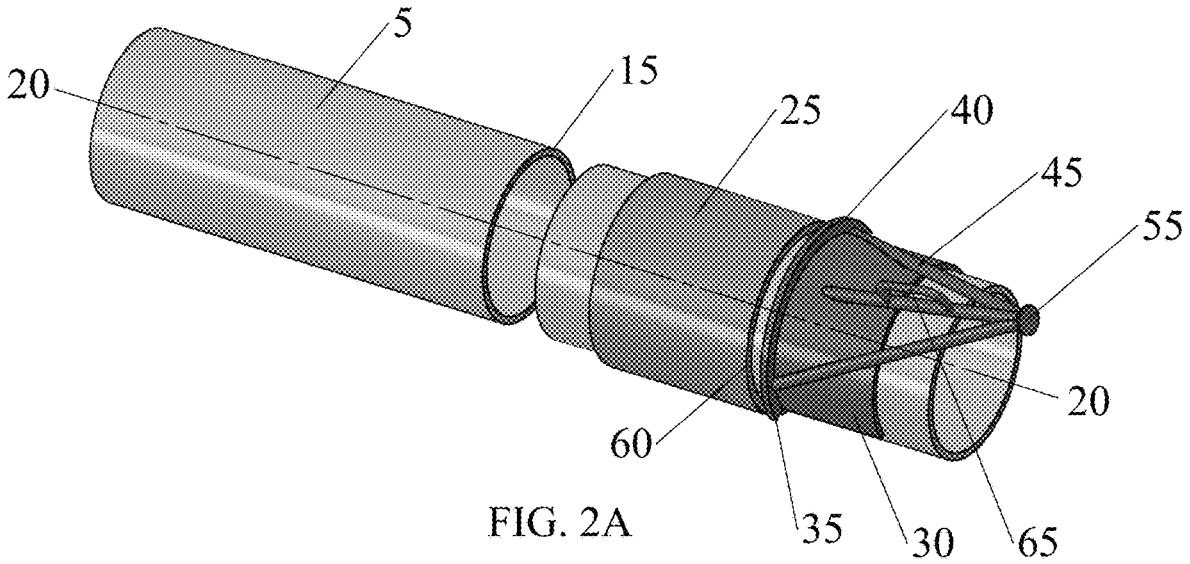
FIG. 2A provides a perspective view of the tool placed next to an uninstalled coupling.
Figure 2B:
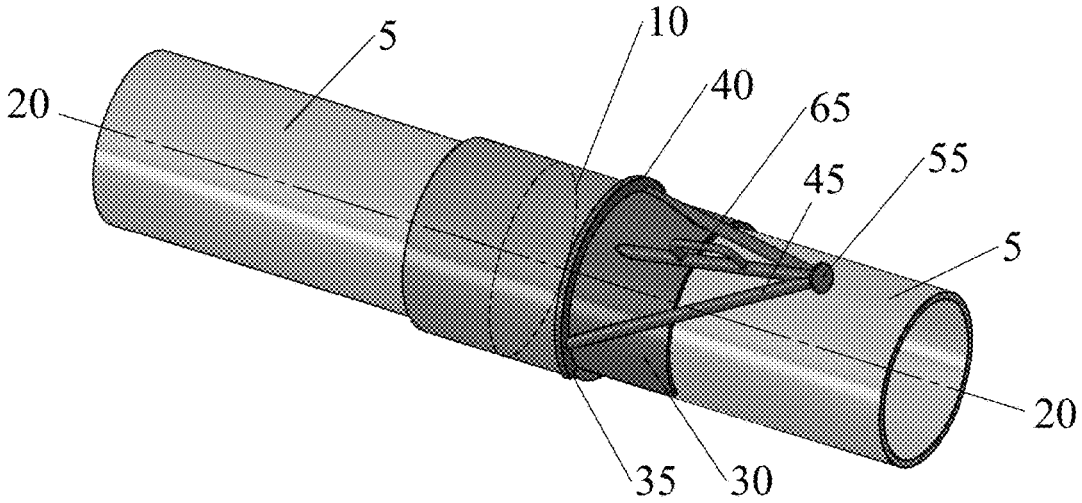
FIG. 2B provides a perspective view of the tool with the coupling installed.

The tool described herein is designed to rest about the exterior surface contour 15 of one of the pipes 5 being joined. Referring now to FIGS. 2A and 2B, the tool is comprised of a cuff 30 having an abutment end 35 and optional lip face 40. The cuff 30 need not completely encircle or circumscribe the pipe's cross-sectional geometry; however, it should be of sufficient area to rest securely about the pipe's exterior surface contour 15. A support frame 45 is mechanically affixed to the cuff 30 and angled away from the abutment end 35 at an acute angle $\alpha$ from the longitudinal axis 20 of the pipe 5. See FIG. 5.

This support frame 45 converges to a junction point 50. The striking face 55 may be mechanically affixed or integral to the junction point 50 or the striking face 55 may be affixed or integral to a segment of the support frame 45 extending from the junction point 50.

A hammer or mallet is used to hit the striking face 55 of the tool. The force applied by each blow is transferred from the striking face 55 to the support frame 45 affixed to the cuff 30. The abutment end 35 located at the distal end of the cuff 30 is in contact with the annulus 60. Force is transferred from the tool to the annulus 60, driving the coupling 25 along the longitudinal axis 20 of the pipe 5. The installer may adjust the force of the hammer strike to regulate the coupling's movement. If the coupling 25 advances beyond the desired position, the tool can be easily removed and repositioned on the opposing annulus 60 and the coupling 25 can be tapped back into place.

An optional lip face 40 may extend from the abutment end 35 of the cuff 30. This lip face 40 is equal to or greater than the annulus 60. Adding a lip face 40 to the tool may further reduce any damage to the coupling 25 as it offers a surface that is at least as high as the annulus 60, increasing the surface area of the tool in contact with the fitting.

Figure 3A:
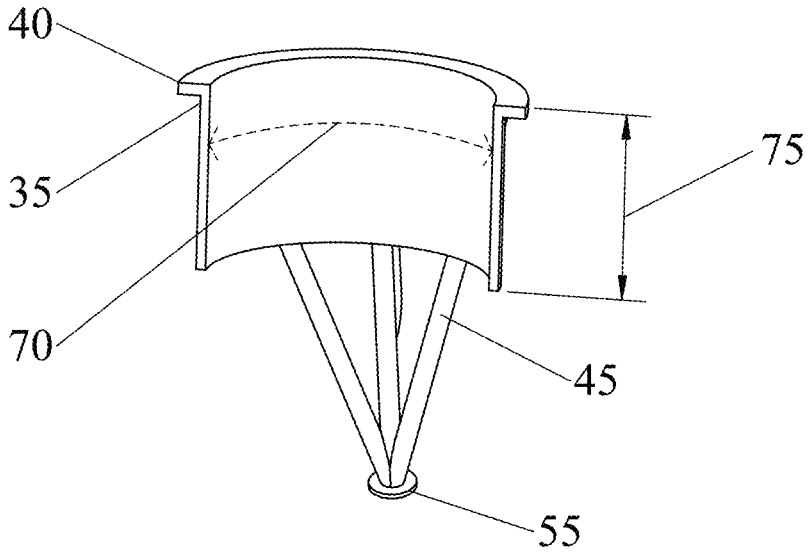
FIG. 3A provides a perspective view of the tool interior showing the cuff length and width.
Figure 3B:
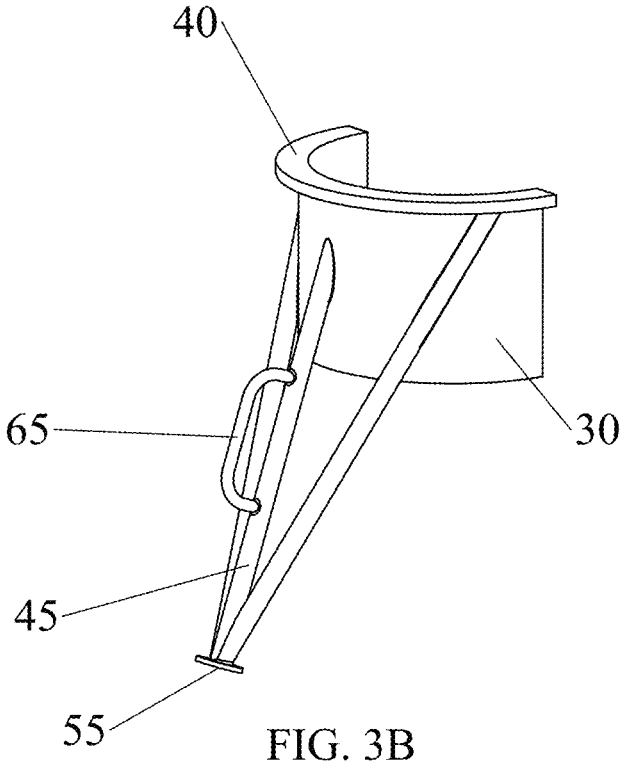
FIG. 3B provides a perspective view of the tool exterior showing the support structure, striking face and optional handle.
Figure 6A:
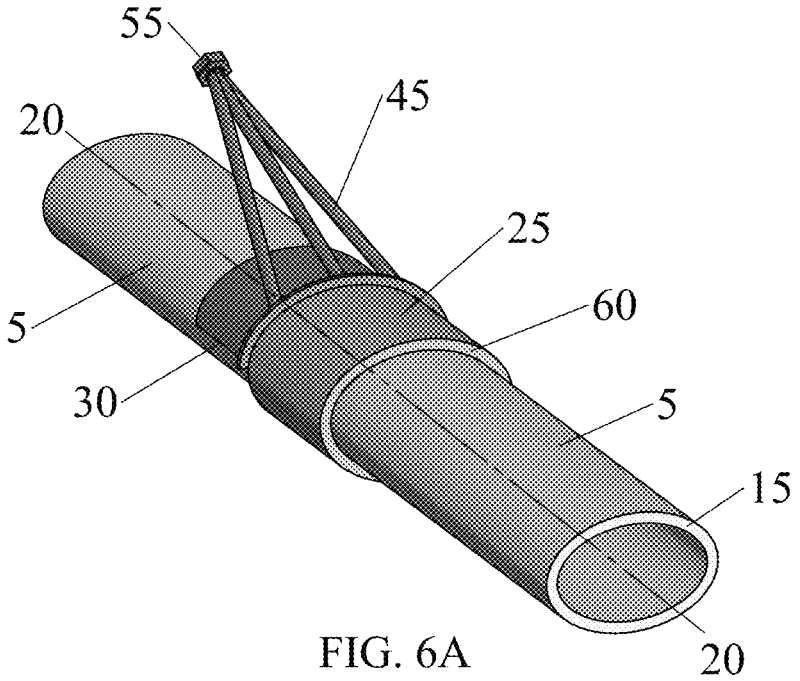
FIGS. 6A-6D provide perspective views of various cross-sectional plumbing geometries and the corresponding tool design for each.
Figure 6B:
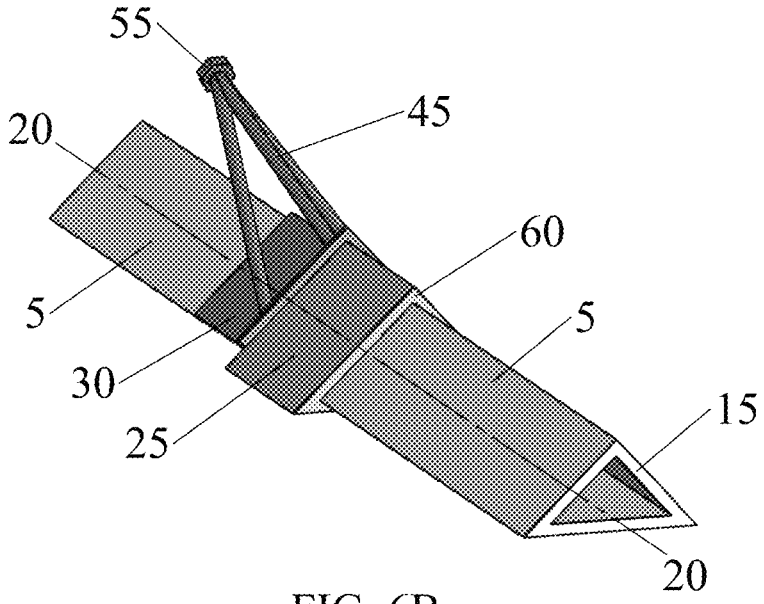
Figure 6C:
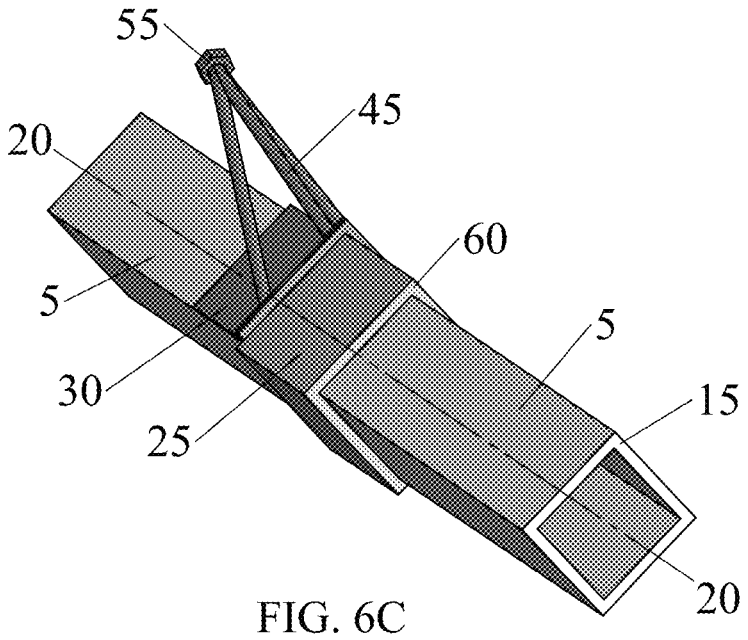
Figure 6D:
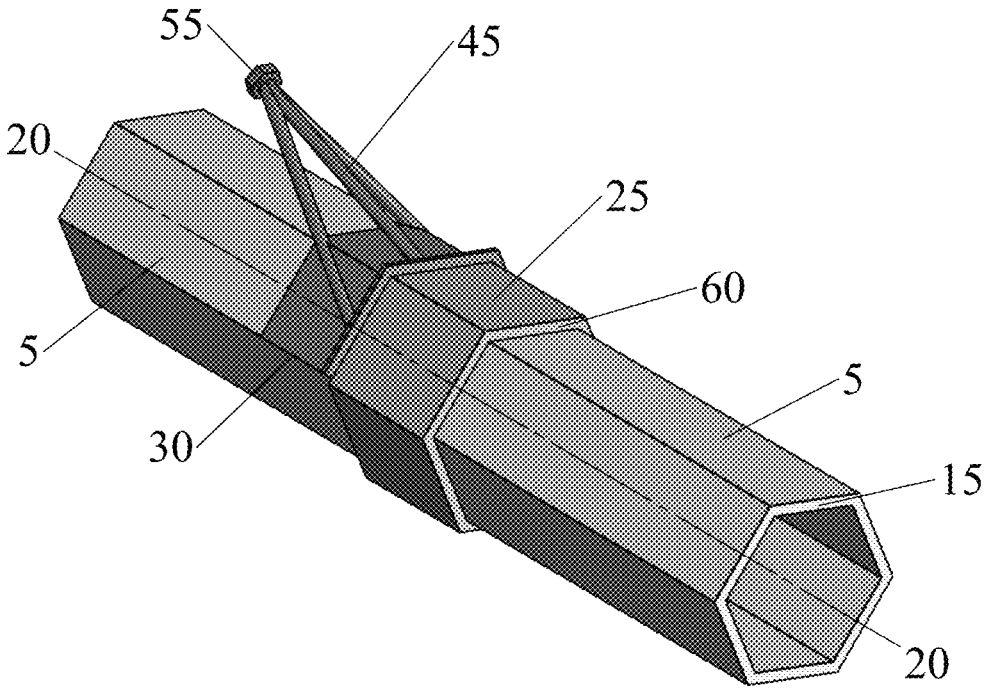

As noted above, piping comes in a variety of shapes and sizes. The cuff geometry must therefore be configured to conform to a segment of the exterior surface contour 15 of the pipe 5 on which it will be used. Consequently, the cuff 30 may take an arcuate shape to accommodate a specific diameter of circular or oval pipe. See FIGS. 2A, 3B and 6A. Alternatively, it may take an L or V shape to conform to a triangular pipe or it may have three or more faces to accommodate other multi-faceted piping. See FIGS. 6B-4D. The tool used for each installation will therefore depend on the size and cross-sectional geometry of the pipe and fittings being installed.

Ideally the tool will be constructed in a balanced manner such that it can sit securely on the exterior surface contour 15 of the piping 5 without being manually held in position. A balanced tool will increase installation safety as the installer's hands need not be near the tool at the time that it is struck. In order to achieve this balance, the weight, position and length of the support frame 45, striking face 55 and handle 65 (if included) must offset the weight of the cuff 30. Referring once again to FIGS. 3A and 3B, ideally the cuff length 70 will be roughly equivalent to the nominal pipe diameter multiplied by $\pi/2$. The cuff width 75 will be roughly equivalent to 0.5*Cuff Length. These calculations are meant as a guide and it should be recognized that any reasonable cuff length or width may be employed. It should also be noted that a variety of materials and configurations can be used in the design of the support frame 45 to develop a balanced tool.

Figure 4A:
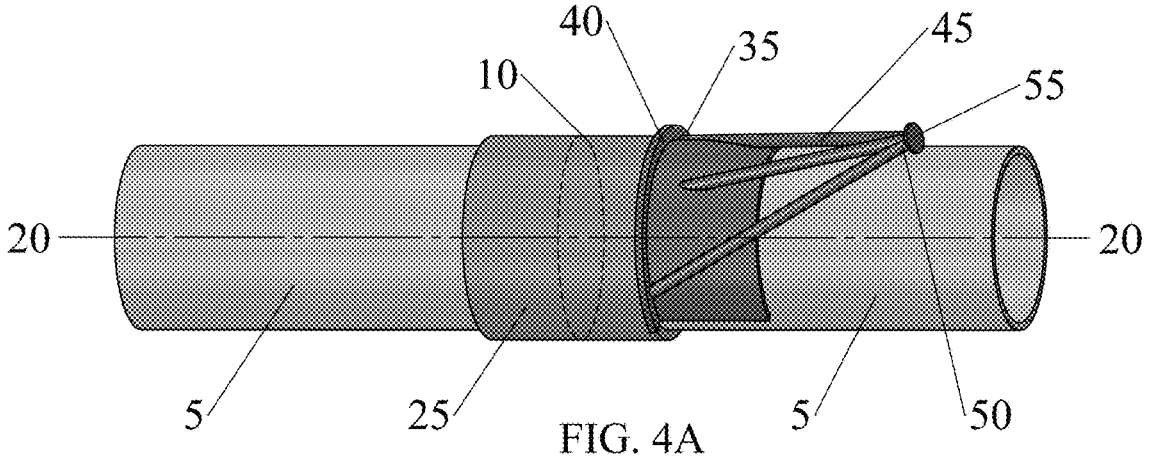
FIGS. 4A-4C provide perspective views of various support frame configurations and striking face designs.
Figure 4B:
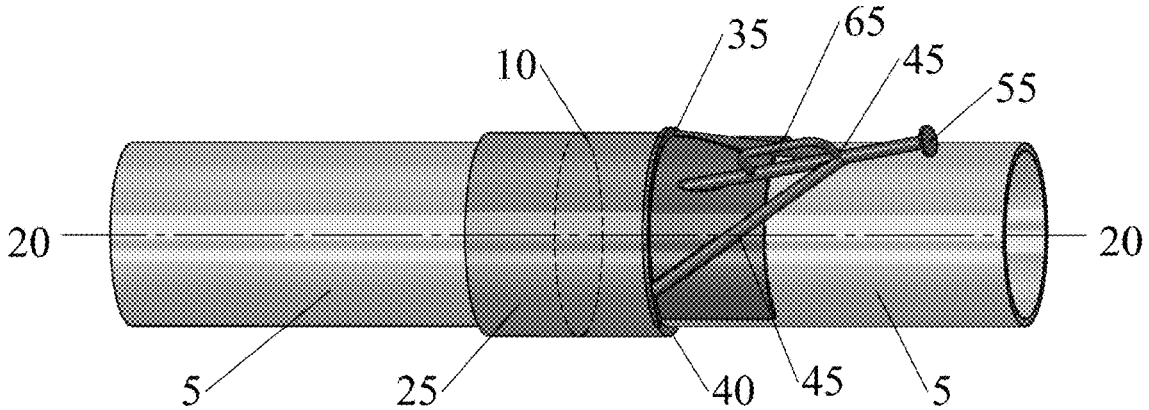
Figure 4C:
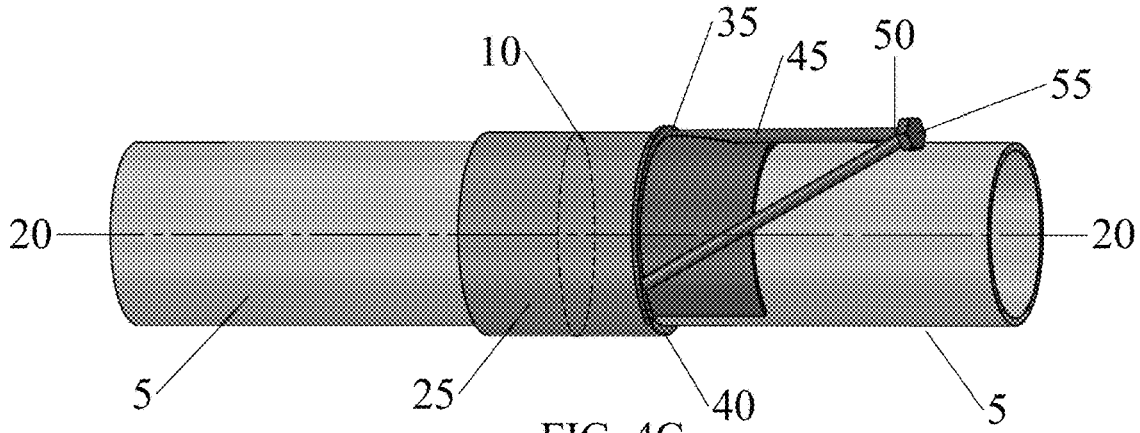

As previously noted, the support frame 45 may be constructed in a variety of ways provided that it is affixed or integral to the cuff 30 and terminates at a striking face 55. FIGS. 4A-4C illustrate a few potential support frame designs. Referring now to FIG. 4A, the first design uses a short post mechanically affixed to the cuff 30 and centered between two longer posts. All three posts converge, meeting at a junction point 50. A striking face 55 is mechanically affixed at that junction point 50 or integral to it. Referring now to FIG. 4B, the second support frame 45 design also employs a short post mechanically affixed to the cuff 30. Two longer posts are mechanically affixed to the cuff 30 and these longer posts converge at a junction point 50 that is midway along the length of the center post. The striking face 55 is mechanically affixed to the proximal end of the long post or it may form an integral part of that post. Referring now to FIG. 4C, this design suggests the use of two long posts that are mechanically affixed to the cuff 30. These two posts converge at a junction point 50 and a striking face 55 is mechanically affixed at that junction point 50 or integral to it.

The striking face 55 may take any variety of shapes or thicknesses provided that it is securely affixed to or an integral part of the support frame 45. In FIGS. 4A and 4B, the striking face 55 is depicted as a circular disc while in FIG. 4C it is shown as a hexagonal head. Any number of configurations may be used provided that the striking face 55 offers sufficient surface area to safely and reliably hit the tool.

Figure 5:
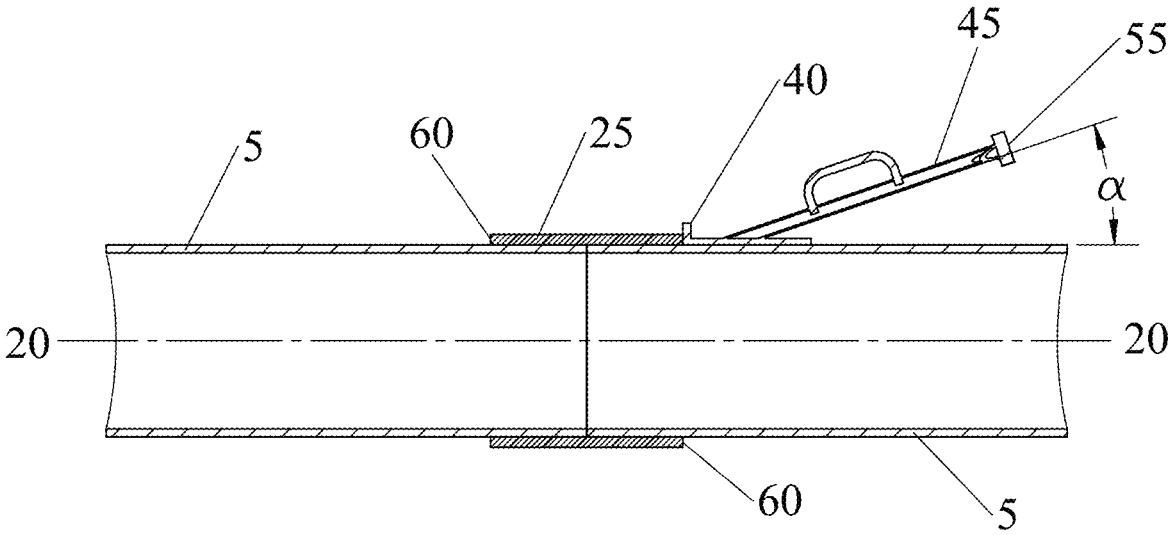
FIG. 5 provides a cross-sectional view of the pipe assembly highlighting the support frame angle.

Referring now to FIG. 5, the angle o and specific location and design of the support frame 45 on the cuff 30 may be adjusted to create balanced tool as well as one that is easy to strike. Ideally the angle $\alpha$ will range from two to fifty degrees, recognizing that the closer the striking face 55 is to the longitudinal axis 20 of the pipe 5, the more force will be transferred to the annulus 60 of the coupling 25 by each hammer strike.

Use and repositioning of the tool may be further enhanced through the addition of an optional handle 65 as depicted in FIGS. 2A, 2B, 3B, 4B and 5. This handle may be affixed to or an integral part of the support frame 45 and may take any form that is easily grasped. Because the installer will likely hold the handle while the tool is struck, it may be beneficial to incorporate a shock absorbing mechanism in the handle.

While the above description contains many specifics, these should be considered exemplifications of one or more embodiments rather than limitations on the scope of the invention. As previously discussed, many variations are possible and the scope of the invention should not be restricted by the examples illustrated herein.

The invention claimed is:

1. A tool that advances a mounted coupling along a length of pipe by transferring force to the coupling when struck, wherein said coupling has an annular thickness and the length of pipe has an exterior surface profile and a longitudinal axis, the tool being able to sit along said length of pipe in a stable position without being manually held in place, the tool comprising:

a cuff capable of sitting on said length of pipe and having an inner surface corresponding to a pipe having one of a circular cross-section, an oval cross-section, a triangular cross-section, a square cross-section, a hexagonal cross-section, and an octagonal cross-section, the cuff having a cuff longitudinal axis, the cuff having a distal end configured to abut the coupling when the cuff is seated on said length of pipe;

a support frame defining a support frame longitudinal axis, the support frame extending from the distal end of the cuff such that the support frame longitudinal axis extends at an acute angle with respect to the cuff longitudinal axis, the acute angle ranging from two to fifty degrees; and a striking face that is affixed to or an integral part of said support frame, said striking face being substantially perpendicular to the longitudinal axis of said support structure.

2. The tool of claim 1, wherein said cuff and striking face are made from a spark resistant material selected from the group consisting of plastic, aluminum, brass, bronze, copper-nickel alloys, copper-aluminum alloys, and copper-beryllium alloys.

3. The tool of claim 1, wherein said tool is coated with a spark resistant material selected from the group consisting of rubber, plastic, and silicone.

4. The tool of claim 1, wherein a handle is affixed to or is an integral part of the tool.

5. The tool of claim 1, wherein a handle having a shock absorbing mechanism is affixed to or is an integral part of the tool.

6. The tool of claim 1, wherein the shape of the cuff corresponds to a pipe having a circular cross-section.

* * * * *